US007583908B2

(12) United States Patent
Yamashita et al.

(10) Patent No.: US 7,583,908 B2
(45) Date of Patent: Sep. 1, 2009

(54) IMAGE FORMING APPARATUS USING AN ELECTROPHOTOGRAPHIC PROCESS AND IMAGE FORMING METHOD

(75) Inventors: Daisuke Yamashita, Izunokuni (JP); Takeshi Watanabe, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 432 days.

(21) Appl. No.: 11/492,382

(22) Filed: Jul. 25, 2006

(65) Prior Publication Data

US 2008/0025741 A1 Jan. 31, 2008

(51) Int. Cl.

| | |
|---|---|
| ***G03G 15/00*** | (2006.01) |
| ***G03G 15/043*** | (2006.01) |
| ***G03G 13/04*** | (2006.01) |
| ***B41J 2/385*** | (2006.01) |

(52) U.S. Cl. ..... 399/49; 399/51; 347/131

(58) Field of Classification Search ..... 399/49, 399/51, 177; 347/131

See application file for complete search history.

(56) References Cited

U.S. PATENT DOCUMENTS 5,937,229 A * 8/1999 Walgrove et al. ..... 399/49 X
6,288,733 B1 * 9/2001 Nakazawa et al. ..... 347/131 X
6,501,917 B1 * 12/2002 Karasawa ..... 399/49 X
6,700,595 B2 * 3/2004 Sugiyama et al. ..... 399/49 X

FOREIGN PATENT DOCUMENTS

| | | |
|---|---|---|
| EP | 1681605 | 7/2006 |
| JP | 11-194553 | 7/1999 |
| JP | 2001-027827 | 1/2001 |

* cited by examiner

*Primary Examiner*—Sandra L Brase
(74) *Attorney, Agent, or Firm*—Turocy & Watson, LLP

(57) ABSTRACT

An image forming apparatus of the invention includes a photoconductor, an exposure unit to expose the photoconductor, a developing unit to develop the photoconductor to form a developed image, a transfer unit to transfer the developed image onto a transfer-receiving member, an image patch creation unit to create an image patch including a minute point, a sensor unit to detect density information of a developed image of the image patch formed on the photoconductor or a transfer image of the image patch formed on the transfer-receiving member, and a picture quality maintaining control unit to change, in a case where the density information detected by the sensor unit is outside a range of a specified reference density, an exposure parameter for forming an image of the minute point so that the density information falls within the range of the specified reference density.

17 Claims, 7 Drawing Sheets

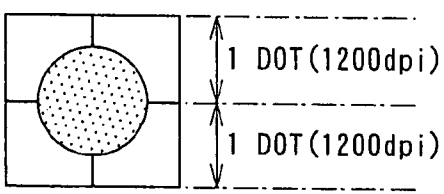
EXCELLENT MINUTE POINT REPRODUCIBILITY
FIG. 4A
DETERIORATED MINUTE POINT REPRODUCIBILITY
FIG. 4B
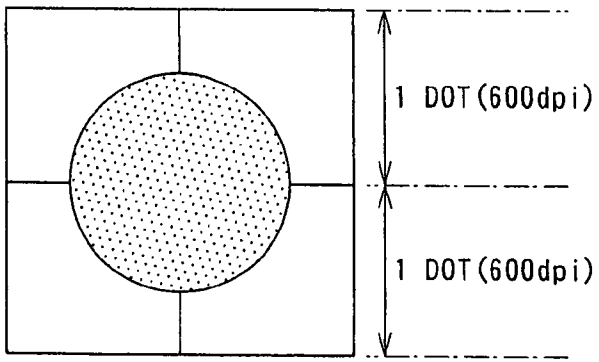
MINUTE POINT REPRODUCIBILITY AFTER CORRECTION
FIG. 4C

| TEST No. | LIFE (k SHEETS) | 0 | | 10 | | 20 | | 30 | | 40 | | 50 | |
|---|---|---|---|---|---|---|---|---|---|---|---|---|---|
| | | MINUTE POINT REPRODUCIBILITY | HT DENSITY | MINUTE POINT REPRODUCIBILITY | HT DENSITY | MINUTE POINT REPRODUCIBILITY | HT DENSITY | MINUTE POINT REPRODUCIBILITY | HT DENSITY | MINUTE POINT REPRODUCIBILITY | HT DENSITY | MINUTE POINT REPRODUCIBILITY | HT DENSITY |
| 1 | ROOM TEMPERATURE AND NORMAL HUMIDITY OF 21℃ AND 50% | A | 0.12 | A | 0.11 | B | 0.09 | C | 0.06 | C | 0.06 | C | 0.06 |
| 2 | CORRECTION BY RESOLUTION CHANGE | A | 0.13 | A | 0.12 | A | 0.11 | A | 0.12 | A | 0.11 | A | 0.11 |
| 3 | CORRECTION BY EXPOSURE PATTERN CHANGE | A | 0.12 | A | 0.11 | A | 0.11 | A | 0.11 | A | 0.12 | A | 0.11 |
| 4 | INITIAL STAGE AFTER BEING LEFT FOR 8 HOURS OR MORE IN LOW TEMPERATURE AND LOW HUMIDITY ENVIRONMENT OF 10℃ AND 20% | B | 0.09 | | | | | | | | | | |
| 5 | CORRECTION BY RESOLUTION CHANGE | A | 0.12 | | | | | | | | | | |
| 6 | CORRECTION BY EXPOSURE PATTERN CHANGE | A | 0.11 | | | | | | | | | | |

"A" ; EXCELLENTLY REPRODUCED
"B" ; BLURED BUT ROUGHLY DISCRIMINATED
"C" ; NOT REPRODUCED

FIG. 7

IMAGE FORMING APPARATUS USING AN ELECTROPHOTOGRAPHIC PROCESS AND IMAGE FORMING METHOD

BACKGROUND OF THE INVENTION

1. Technical Field of the Invention

The present invention relates to an image forming apparatus and an image forming method, and particularly to an image forming apparatus using an electrophotographic process to form an image and an image forming method.

2. Related Art

In an image forming apparatus of an electrophotographic system, there is known that characteristics of electrophotographic materials such as a toner and a photoconductor are changed by a change in the surrounding environment, such as temperature and humidity, or the usage time of the apparatus, and the density of an image to be formed is changed. As a result, for example, a halftone density of an image is changed, or a minute point or line can not be reproduced at the same size.

Then, in a recent image forming apparatus, in order to prevent the change of the halftone density or to ensure the reproducibility of the minute point or line, a picture quality adjustment mechanism is often mounted.

The mode of the picture quality adjustment mechanism includes a mode of using a method in which the picture quality is maintained by an open-loop control, a mode of using a method in which the picture quality is maintained by a closed-loop control, or a mode of using a method in which these are combined.

In the open-loop control, environmental conditions, the usage time of the apparatus and the like are monitored, and process conditions such as an exposure amount are changed according to a table provided in the image forming apparatus, so that the picture quality is maintained.

On the other hand, in the closed-loop control, an image of a specified image patch is developed on a photoconductor within a period except for the normal image forming operation period. Then, the patch density of the developed or transferred image is detected by a reflectivity sensor, a transmissivity sensor or the like provided in the vicinity of the photoconductor or a transfer-receiving member, and process conditions and the like are changed based on a detected density signal.

It is widely performed to stabilize the gradation reproducibility and the reproducibility of a thin line or a minute point by the open-lop control or the closed-loop control as stated above, and in general, the control as stated above is called "picture quality maintaining control".

In a process of a general electrophotographic apparatus, after a photoconductive body such as a photoconductor is uniformly charged, a light with an intensity corresponding to the density of an image to be developed is irradiated to the photoconductor, and the potential on the surface of the photoconductor is attenuated by optical attenuation to form an electrostatic latent image. As means for irradiating the light to the photoconductor, that is, as exposing means, a laser diode or an LED is used.

Here, the deterioration of the reproducibility of the minute point is caused by the change of characteristics of electrophotographic materials, such as a toner and a photoconductor, due to a change of temperature/humidity, a change with the passage of time, a use history and the like, and it can not be avoided to a certain degree. Then, in the case where the reproducibility of the minute point is deteriorated, in order to improve the reproducibility, various picture quality maintaining control methods have been proposed. For example, there is a method in which the picture quality maintaining control is performed by changing the amount of light to expose the surface of the photoconductor or the pulse width of a light emission signal.

As this example, JP-A-2001-27837 discloses such a technique that there are provided charging means for charging the surface of a photoconductor, exposing means for forming an electrostatic latent image by irradiating a light corresponding to an image to be formed to the surface of the photoconductor charged by the charging means, a toner supply device to supply toner, and detection means for detecting the density of the toner moved from the toner supply device to the surface of the photoconductor, and gradation reproducibility is changed according to the density, detected by the detection means, of the toner moved to the surface of the photoconductor.

JP-A-2001-27837 discloses such a technique that a change in gradation reproducibility is performed by changing at least one of an exposure amount of light to expose a photoconductor, a charging potential, and data of a gradation table, and further, the change of the exposure amount is performed by an exposure pulse width modulation or pulse intensity modulation.

Besides, JP-A-11-194553 discloses a technique characterized in that an image forming apparatus to visualize an image by forming plural minute points includes means for outputting a test pattern having at least an intermediate density part, and means for performing a density correction for each of the minute points by reading the test pattern so that each of the minute points comes to have a regulated density. An intermediate value of the read density can be set as the regulated density, and a density difference shifted from the intermediate value of the read density is stored for each pixel, so that the density correction can be performed. The density correction is performed with a corrected light amount of a dot exposing laser for each pixel, and the change of the corrected light amount is performed with a pulse width modulation.

However, as in the above technique, when the correction of the density is performed by the control of the pulse width of the pulse width modulation, there arises a problem that the reproducibility becomes unstable due to the fluctuation of the response of a short pulse. Besides, in the case where the density is reduced due to the environment or the number of use years, there is also a case where the reproduction itself of the minute point can not be performed, and there also occurs a case where merely the adjustment of the pulse width is insufficient.

SUMMARY OF THE INVENTION

The invention has been made in view of the above circumstances, and it is an object to provide an image forming apparatus and an image forming method, in which the reproducibility of a minute point can be stably maintained even in a case where an environment such as temperature and humidity is changed or the use is made for a long period of time.

In order to achieve the above object, an image forming apparatus according to an aspect of the invention includes a photoconductor, an exposure unit configured to expose the photoconductor by outputting a light signal subjected to a pulse width modulation, a developing unit configured to develop the photoconductor to form a developed image on the photoconductor, a transfer unit configured to transfer the developed image onto a transfer-receiving member to form a transfer image, an image patch creation unit configured to create an image patch including a minute point, a sensor unit configured to detect density information of a developed image of the image patch formed on the photoconductor or a transfer image of the image patch formed on the transfer-receiving member, and a picture quality maintaining control unit configured to change, in a case where the density information detected by the sensor unit is outside a range of a specified reference density, an exposure parameter for forming an image of the minute point so that the density information falls within the range of the specified reference density.

Besides, in order to achieve the above object, an image forming apparatus according to another aspect of the invention includes exposing means for exposing a photoconductor by outputting a light signal subjected to a pulse width modulation, developing means for developing the photoconductor to form a developed image on the photoconductor, transfer means for transferring the developed image onto a transfer-receiving member to form a transfer image, image patch creation means for creating an image patch including a minute point, sensor means for detecting density information of a developed image of the image patch formed on the photoconductor or a transfer image of the image patch formed on the transfer-receiving member, and picture quality maintaining control means for changing, in a case where the density information detected by the sensor means is outside a range of a specified reference density, an exposure parameter for forming an image of the minute point so that the density information falls within the range of the specified reference density.

Besides, in order to achieve the above object, an image forming method according to an aspect of the invention is an image forming method of an image forming apparatus including a photoconductor, an exposure unit configured to expose the photoconductor by outputting a light signal subjected to a pulse width modulation, a developing unit configured to develop the photoconductor to form a developed image on the photoconductor, and a transfer unit configured to transfer the developed image onto a transfer-receiving member to form a transfer image, and includes creating an image patch including a minute point, detecting density information of a developed image of the image patch formed on the photoconductor or a transfer image of the image patch formed on the transfer-receiving member, and changing, in a case where the density information detected by the sensor unit is outside a range of a specified reference density, an exposure parameter for forming an image of the minute point so that the density information falls within the range of the specified reference density.

BRIEF DESCRIPTION OF THE DRAWINGS

In the accompanying drawings:

FIGS. 4A to 4C are views showing an operation example of the picture quality maintaining control method according to the first embodiment;

FIG. 7 is a table showing results of comparison tests.

DETAILED DESCRIPTION OF THE EMBODIMENTS

Embodiments of an image forming apparatus and an image forming method of the invention will be described with reference to the accompanying drawings.

(1) Structure of Image Forming Apparatus

Figure 1:
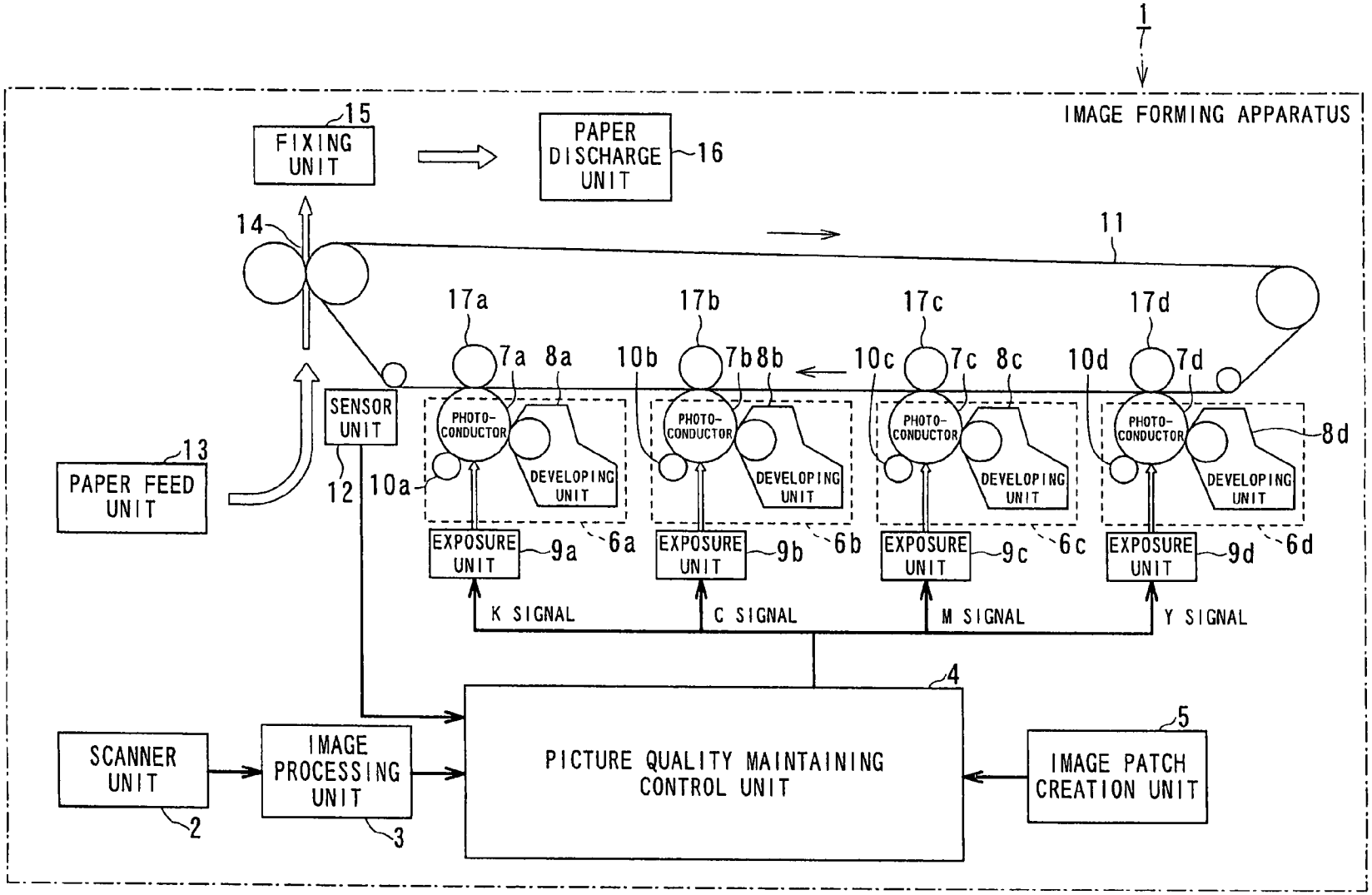
FIG. 1 is a view showing a whole structural example of an image forming apparatus according to an embodiment of the invention.

FIG. 1 is a view showing a structural example of an image forming apparatus 1 according to an embodiment. As shown in FIG. 1, the image forming apparatus 1 is, for example, a tandem type color copier. The image forming apparatus 1 includes a scanner unit 2, an image processing unit 3, a picture quality maintaining control unit 4, an image patch creation unit 5, exposure units 9*a*, 9*b*, 9*c*, 9*d*, process cartridges 6*a*, 6*b*, 6*c* and 6*d*, an intermediate transfer belt (transfer-receiving member) 11, intermediate transfer rollers (transfer units) 17*a*, 17*b*, 17*c* and 17*d*, a paper feed unit 13, a recording sheet transfer unit 14, a fixing unit 15 and a paper discharge unit 16.

In the scanner unit 2, a document is read, and image data of, for example, three primary colors of R, G and B are created. In the image processing unit 3, color conversion processing from the three primary colors of R, G and B to four print colors of K (black), C (cyan), M (magenta) and Y (yellow) is performed on the respective image data, and further, various image processings are performed.

The image-processed K signal, C signal, M signal and Y signal are inputted to the exposure units 9*a*, 9*b*, 9*c* and 9*d* through the picture quality maintaining control unit 4.

The process cartridges 6*a*, 6*b*, 6*c* and 6*d* correspond to the four colors for color printing, are constructed of the four process cartridges for the K signal, the C signal, the M signal and the Y signal, and are structured to be attachable/detachable to/from the image forming apparatus 1. The basic structures of the respective process cartridges 6*a*, 6*b*, 6*c* and 6*d* are the same although the colors of toners included in developing units 8*a*, 8*b*, 8*c* and 8*d* are different. Then, in the following description concerning the process cartridge, the suffixes of a, b, c and d attached to reference numerals will be omitted and the description will be made.

The process cartridge 6 includes a photoconductor 7, the developing unit 8, and a charging device 10. The surface of the photoconductor 7 is charged to a specified potential by the charging device 10, and an electrostatic latent image is formed on the surface by a light, for example, a laser light irradiated from the exposure unit 9. The electrostatic latent image is developed with a toner supplied from the developing unit 8, and the developed image corresponding to each toner color is formed on the surface of the photoconductor 7.

The developed image formed on the photoconductor 7 is superimposed and transferred onto the intermediate transfer belt 11 in the order of Y, M, C and K, and at the time point when it passes the photoconductor 7*a* for K, a full color toner image in which the four colors are combined is formed on the intermediate transfer belt 11.

The density (or reflectivity) of the toner image is detected by a sensor unit 12 and is supplied for the processing of a picture quality maintaining control described later.

The toner image on the intermediate transfer belt 11 is transferred in the recording sheet transfer unit 14 to the recording sheet supplied from the paper feed unit 13. The toner image transferred to the recording paper is fixed to the recording sheet in the fixing unit 15, and it is discharged to the outside from the paper discharge unit 16.

(2) Picture Quality Maintaining Control Method (first embodiment)

A picture quality maintaining control method of the image forming apparatus 1 constructed as described above will be described.

The photosensitive characteristic of the photoconductor 7 and the charging characteristic of the toner are changed according to the environment in which the image forming apparatus 1 is installed or the number of use years. Thus, a change occurs in the quality of an image formed by the image forming apparatus 1. Especially, there is a tendency that the reproducibility of a minute point is deteriorated. More specifically, when the number of use years becomes large, the diameter of the minute point formed becomes small and it blurs, or in some cases, it can not be reproduced (the image of the minute point becomes too small to be formed). Also in the case where the use environment such as temperature and humidity is significantly changed, similarly, there is also a case where the reproducibility of the minute point is deteriorated.

The picture quality maintaining control method of the image forming apparatus 1 according to the embodiment provides means and method in which even in the case where the environment such as temperature and humidity is changed or the use is made for a long period of time, the reproducibility of the minute point is stably maintained.

Figure 2:
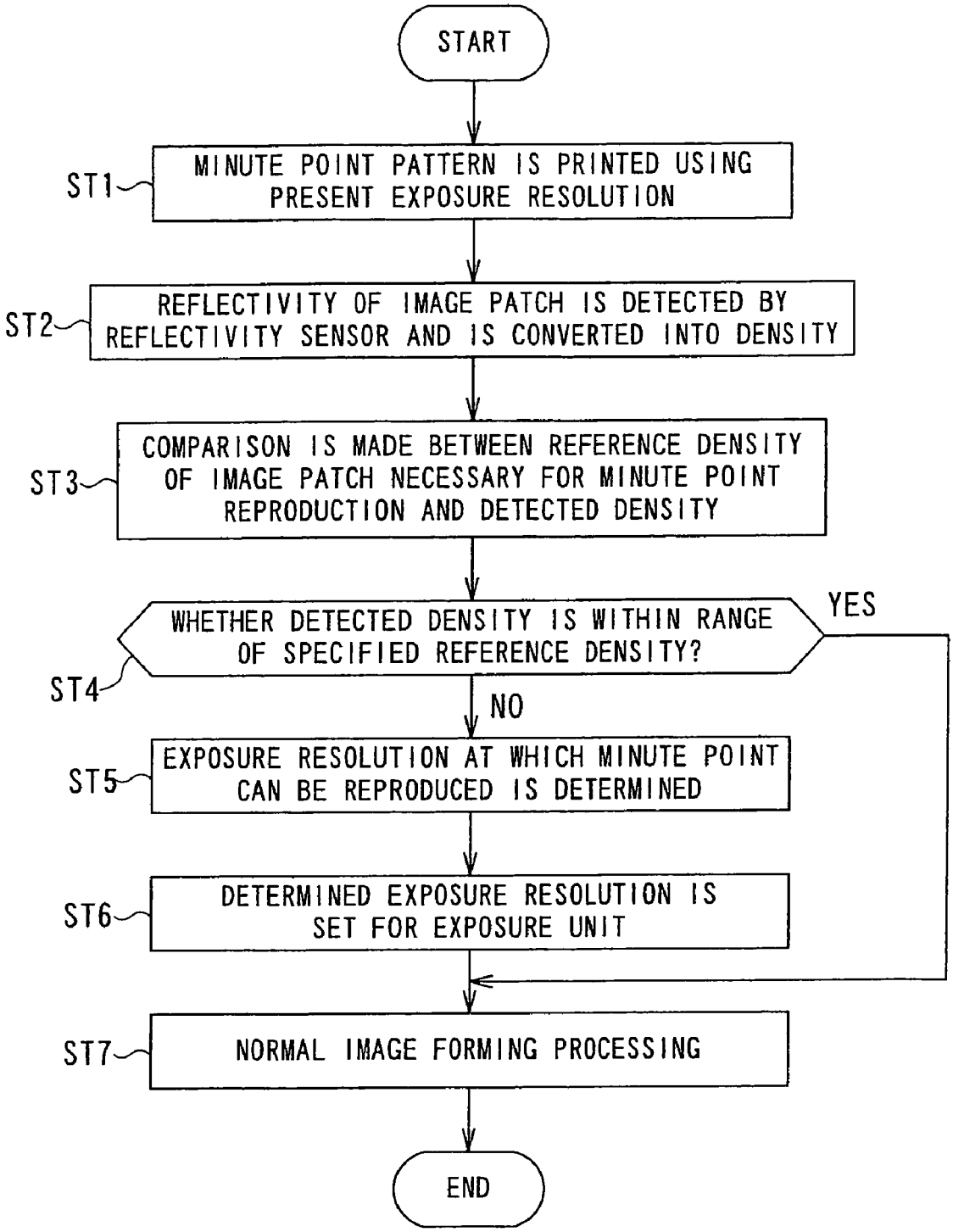
FIG. 2 is a flowchart showing a processing example of an image forming method (picture quality maintaining control method) according to a first embodiment of the invention.

FIG. 2 is a flowchart showing a processing example of a picture quality maintaining control method according to a first embodiment.

In the picture quality maintaining control according to the first embodiment, the picture quality of a minute point is maintained by changing an exposure resolution as one of exposure parameters.

First, at step ST1, a presently set exposure resolution, for example, an exposure resolution of 1200 dpi is used, and an image patch of a minute point pattern is printed.

Figure 3:
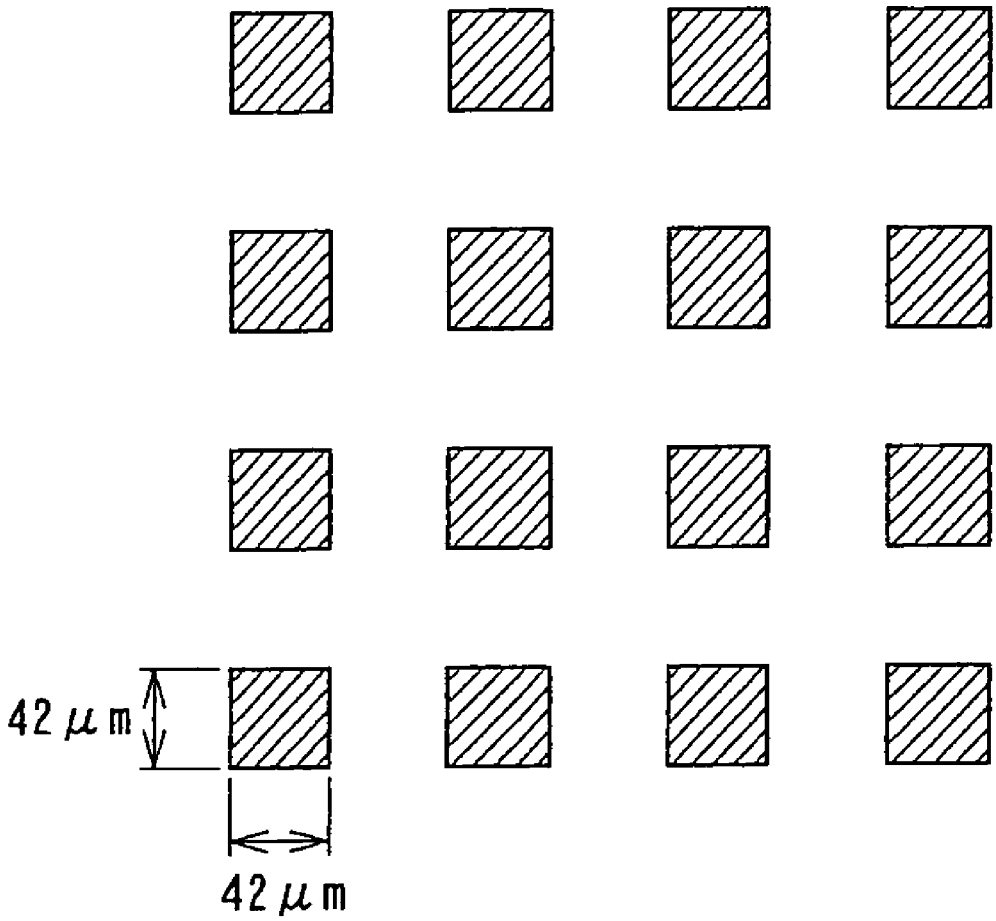
FIG. 3 is a view showing an example of an image patch including a minute point pattern.

FIG. 3 is a view showing an example of the minute point pattern. In a state where the exposure resolution is set to 1200 dpi, a minute point of 2×2 dots is arranged at intervals of 8 dots in both a main scanning direction and a sub-scanning direction. At the setting of 1200 dpi, the length per 1 dot is about 21 μm in both length and width, and the length of 2 dots becomes about 42 μm.

The minute point pattern is created by the image patch creation unit 5, and the minute point pattern is supplied to the exposure unit 9 through the picture quality maintaining control unit 4. The exposure unit 9 forms an electrostatic latent image of the minute point pattern on the photoconductor 7. The electrostatic latent image is developed by the developing unit 8, and a toner developed image is formed on the surface of the photoconductor 7. The toner developed image on the surface of the photoconductor 7 is intermediately transferred onto the intermediate transfer belt 11.

At step ST2, the reflectivity of the minute point pattern formed on the intermediate transfer belt 11 is detected by the sensor unit 12, and the reflectivity is converted into density.

The density of the image patch of the minute point pattern in the case where the reproduction of the respective minute points is excellent is previously held as a reference density, and at step ST3, the reference density and the density detected at step ST2 are compared with each other.

When the detected density is within the range of the reference density (Yes at step ST4), advance is made to step ST7, and a normal image forming processing is performed without changing the set exposure resolution (in this case, 1200 dpi).

On the other hand, when the detected density is outside the range of the reference density (No at step ST4), an exposure resolution at which the minute point can be reproduced is determined, and the determined exposure resolution is set for the exposure unit 9 (step ST5, 6). Thereafter, the normal image forming processing is performed using the set exposure resolution (step ST7).

FIGS. 4A to 4C schematically show a state in which the reproducibility of a minute point is ensured by changing the exposure resolution.

FIG. 4A shows the minute point at the time when the reproducibility is excellent, and under the setting of the exposure resolution of 1200 dpi, one minute point is formed of 4 dots.

When the characteristics of the photoconductor 7 or the toner are changed due to the long time use or the change of the environment, as shown in FIG. 4*b*, the diameter of the minute point is changed from the first excellent state, and the size of the diameter becomes small. In extreme cases, the minute point blurs and the reproducibility can not be ensured.

Then, by the foregoing picture quality maintaining control, the exposure resolution is changed from 1200 dpi and is reduced to, for example, 600 dpi. As a result, as exemplified in FIG. 4C, since the size of the diameter per 1 dot is increased, the diameter of the decreased minute point is again increased, and the reproducibility of the minute point is ensured.

Although a specific changing method of the resolution is not particularly limited, for example, there is a method of increasing the power of a laser light. By increasing the power of the laser light, the thickness of the laser beam can be enlarged equivalently, and the exposure resolution can be reduced. Besides, a method may be such that the exposure resolution is reduced by widening the pulse modulation width of laser light.

(3) Picture Quality Maintaining Control Method (Second Embodiment)

Figure 5:
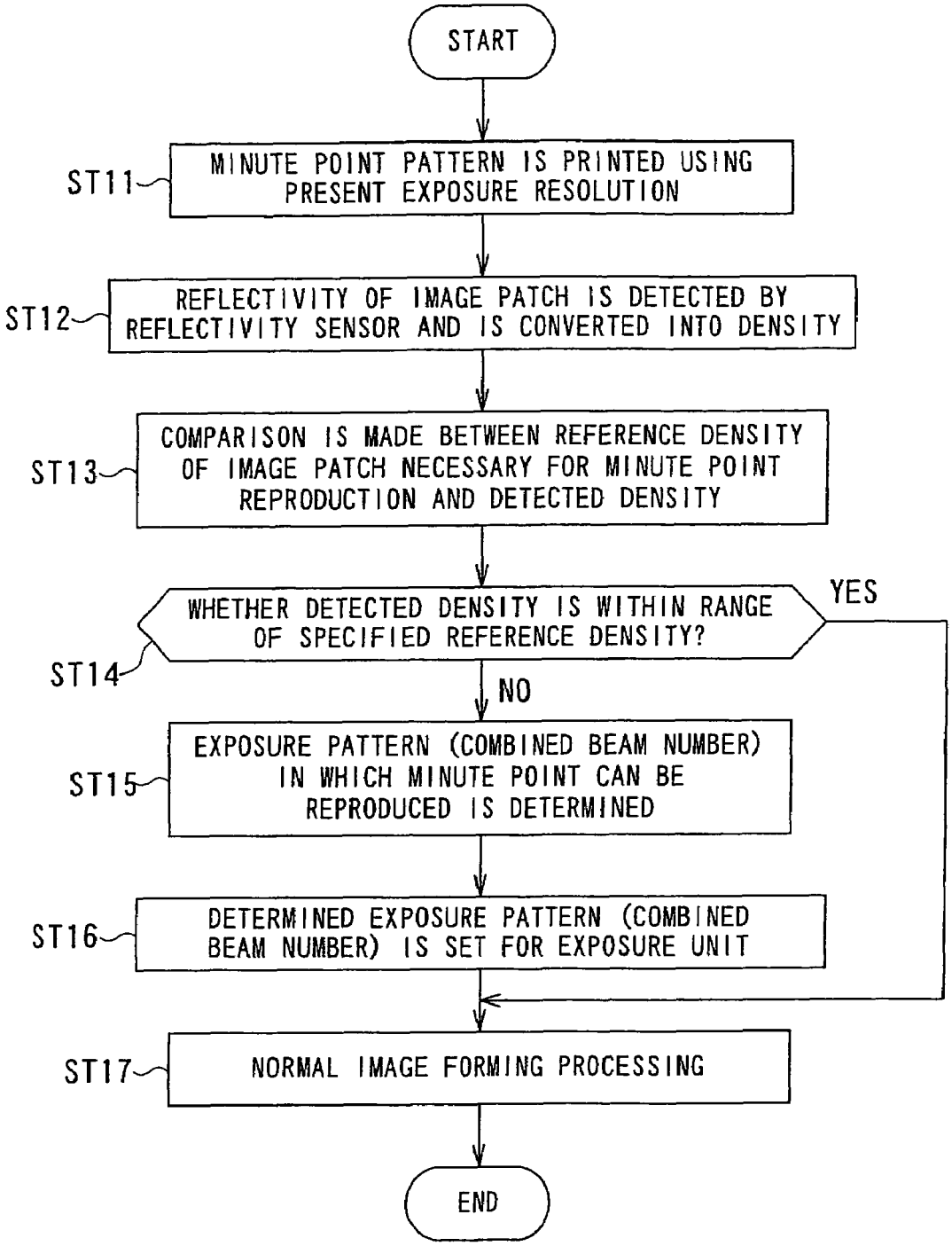
FIG. 5 is a flowchart showing a processing example of an image forming method (picture quality maintaining control method) according to a second embodiment of the invention.

FIG. 5 is a flowchart showing a processing example of a picture quality maintaining control method according to a second embodiment. In the first embodiment, the method of reducing the exposure resolution among the exposure parameters is adopted as the method of enlarging the diameter of the decreased minute point. On the other hand, in the second embodiment, the exposure resolution is not changed, and a method is adopted in which an exposure pattern among the exposure parameters is changed, and the diameter of the decreased minute point is enlarged.

Here, the exposure pattern for forming the minute point means the dot number of dots (each being a dot formed by one laser beam) forming the minute point or the arrangement of dots.

Processing from step ST11 to step ST14 of FIG. 5 is the same processing as the processing from step ST1 to step ST4 indicating the first embodiment. That is, an image patch of a minute point pattern as exemplified in FIG. 3 is formed on the intermediate transfer belt 11, and it is determined whether or not the density is outside the range of the specified reference density (for example, not higher than the reference density).

When the detected density is within the range of the reference density (Yes at step ST14), advance is made to step ST17, and the normal image forming processing is performed without changing the set exposure pattern.

On the other hand, the detected density is outside the range of the reference density (No at step ST14), an exposure pattern in which the minute point can be reproduced is determined, and the determined exposure pattern is set for the exposure unit 9 (step ST15, ST16). Thereafter, the normal image forming processing is performed using the set exposure pattern (step ST17).

FIGS. 6A to 6D schematically show a state in which the reproducibility of a minute point is ensured by changing the exposure pattern.

Figure 6A:
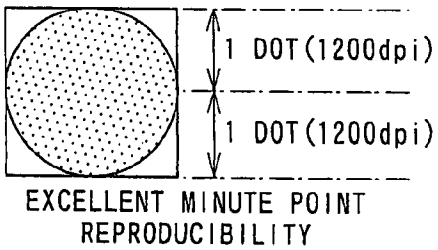
FIGS. 6A to 6D are views showing an operation example of the picture quality maintaining control method according to the second embodiment.

FIG. 6A shows the minute point at the time when the reproducibility is excellent, and under the setting of an exposure resolution of 1200 dpi, one minute point is formed of an exposure pattern including four dots in which two dots are arranged in each of length and width.

Figure 6B:
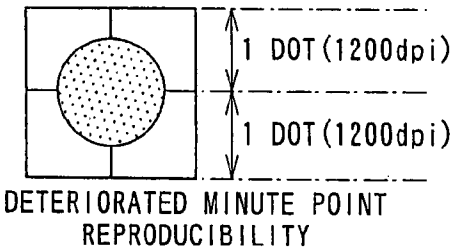

When the characteristics of the photoconductor 7 or the toner are changed due to the long time use or the change of the environment, as shown in FIG. 6B, the size of the diameter becomes small, and the first excellent reproducibility can not be ensured.

Figure 6C:
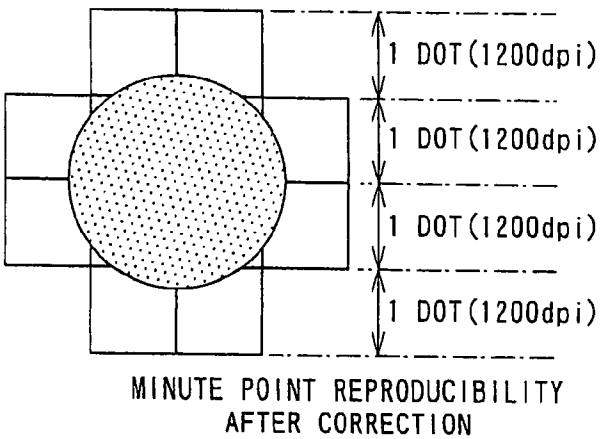

Then, the exposure pattern is changed to an exposure pattern as exemplified in FIG. 6C by the foregoing picture quality maintaining control. The exposure pattern exemplified in FIG. 6C is the exposure pattern using 8 dots to form the minute point. Two dots are added to the outside of each of four sides of the first exposure pattern using 2×2 dots in length and width, and the area of the exposure pattern is widened.

The second embodiment is the embodiment in which the exposure pattern is changed to ensure the reproducibility of the minute point, and since the exposure pattern has the dot number or the dot array as its element, the degree of freedom is high, and various exposure patterns can be formed.

Figure 6D:
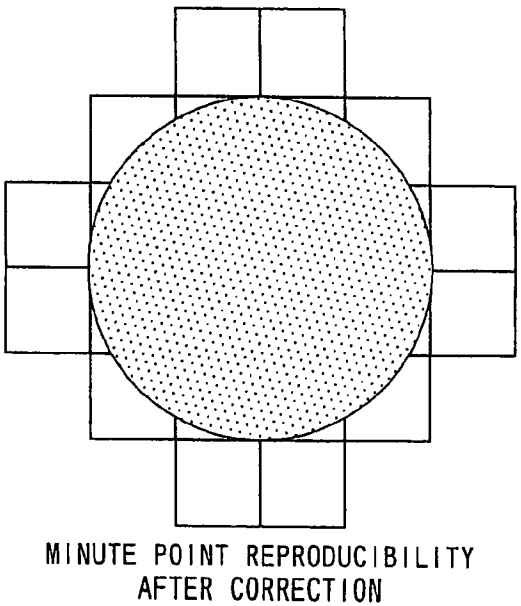

For example, the usage time has further passed, and in the case where the minute point is further decreased from the state shown in FIG. 6C, the exposure pattern is further changed, and as exemplified in FIG. 6D, it is relatively easily realized that one minute point is changed to an exposure pattern of 4×4 dots, or an exposure pattern in which 2 dots are further added to each of four sides of the exposure pattern of 4×4 dots. By this, even in the case where the reproducibility of the minute point is reduced by aging or the like, the original reproducibility can be ensured by changing the exposure pattern.

Although the processing exemplified in the flowchart of FIG. 5 is, so to speak, the closed-loop processing, in addition to this, there is also a mode of using an open-loop processing.

In this case, a counter to measure the usage time of the image forming apparatus 1, or a counter to count the number of print sheets is provided, and when the counter exceeds a specified value, the exposure pattern is changed from the first exposure pattern to another exposure pattern which is, for example, composed of more dots.

(4) Effect Confirmation Test

FIG. 7 is a view showing results of comparison of the reproducibility of the minute point, due to the usage time or the change of the environment, between a case where the foregoing picture quality maintaining control is performed and a case where the picture quality maintaining control is not performed. Here, the usage time is indicated by the number of print sheets.

Tests No. 1 to 3 indicate the comparison results of the reproducibility of the minute point in a room temperature and normal humidity environment.

Test No. 1 indicates the print result of the case where the picture quality maintaining control is not performed. The reproducibility with respect to the number of print sheets in the tests was evaluated such that, at a resolution of 1200 dpi, whether or not an isolated point of 2×2 dots could be reproduced was observed with the naked eye under magnification. Evaluation was made at three levels: "A" indicates that it was excellently reproduced, "B" indicates that it blurred but was roughly discriminated, and "C" indicates that it could not be reproduced.

As a result, in the case of test No. 1 in which the picture quality maintaining control was not performed, a blur occurred at 20,000 (20 k) sheets, and the minute point could not be reproduced at 30,000 (30 k) sheets or more.

On the other hand, test No. 2 is the test of the case where the picture quality maintaining control method (correction by the resolution change) of the first embodiment was applied, and test No. 3 is the test of the case where the picture quality maintaining control method (correction by the exposure pattern change) of the second embodiment was applied. In both test No. 2 and test No. 3, it was confirmed that when the picture quality maintaining control was performed, even if 50,000 (50 k) sheets were printed, the reproducibility of the minute point was excellently maintained.

Test No. 4 to No. 6 indicate comparison results of the reproducibility of the minute point in a low temperature and low humidity environment.

Test No. 4 is the result when the picture quality maintaining control was not performed in the low temperature and low humidity environment (temperature of 10° C. and humidity of 20%), and after being left in the low temperature and low humidity environment for 8 hours, a blur occurred.

On the other hand, in test No. 5 of the case where the picture quality maintaining control method (correction by the resolution change) of the first embodiment was applied, and test No. 6 of the case where the picture quality maintaining control method (correction by the exposure pattern change) of the second embodiment was applied, it was confirmed that the reproducibility of the minute point was excellent even after being left for 8 hours.

From the results of the effect confirmation tests, it was confirmed that the reproducibility of the minute point became excellent by applying the picture quality maintaining control of the first and the second embodiments.

As described above, according to the image forming apparatus of this embodiment and the image forming method, even in the case where the environment such as temperature and humidity is changed or the use is made for a long period of time, the reproducibility of the minute point can be stably maintained.

It should be understood that the present invention is by no means restricted to the above-described embodiments; rather, in carrying out the invention, various alterations and modifications may be made with regard to the components without departing from the spirit and scope of the present invention. Further, various arrangements may be made within the scope of the present invention by arranging the components in various ways, or by omitting one or more of the components. Moreover, arrangements obtained by suitably combining the components of the above-described embodiments with components of other embodiments according to the present invention are also encompassed by the present invention.

What is claimed is:

1. An image forming apparatus comprising:

a photoconductor;

an exposure unit configured to expose the photoconductor by outputting a light signal subjected to a pulse width modulation;

developing unit configured to develop the photoconductor to form a developed image on the photoconductor;

a transfer unit configured to transfer the developed image onto a transfer-receiving member to form a transfer image;

an image patch creation unit configured to create an image patch including a minute point;

a sensor unit configured to detect density information of a developed image of the image patch formed on the photoconductor or a transfer image of the image patch formed on the transfer-receiving member;

a picture quality maintaining control unit configured to change, in a case where the density information detected by the sensor unit is outside a range of a specified reference density, an exposure parameter for forming an image of the minute point so that the density information falls within the range of the specified reference density; and a counter to count a usage time, wherein the picture quality maintaining control unit changes the exposure pattern according to an increase in a count value of the counter.

2. The image forming apparatus according to claim 1, wherein the image patch is an image patch in which a pixel size is smaller than 1200 dpi and which includes a plurality of isolated minute points.

3. The image forming apparatus according to claim 1, wherein the exposure parameter is an exposure resolution.

4. The image forming apparatus according to claim 3, wherein the picture quality maintaining control unit changes the exposure resolution, set for the exposure unit, by changing power of the light signal.

5. The image forming apparatus according to claim 3, wherein the picture quality maintaining control unit changes the exposure resolution, set for the exposure unit, by changing a pulse width used for the pulse width modulation.

6. The image forming apparatus according to claim 1, wherein the exposure parameter is an exposure pattern for forming the image of the minute point.

7. An image forming apparatus comprising:

exposing means for exposing a photoconductor by outputting a light signal subjected to a pulse width modulation;

developing means for developing the photoconductor to form a developed image on the photoconductor;

transfer means for transferring the developed image onto a transfer-receiving member to form a transfer image;

image patch creation means for creating an image patch including a minute point; sensor means for detecting density information of a developed image of the image patch formed on the photoconductor or a transfer image of the image patch formed on the transfer-receiving member;

picture quality maintaining control means for changing, in a case where the density information detected by the sensor means is outside a range of a specified reference density, an exposure parameter for forming an image of the minute point so that the density information falls within the range of the specified reference density; and count means for counting a usage time, wherein the picture quality maintaining control means changes the exposure pattern according to an increase in a count value of the count means.

8. The image forming apparatus according to claim 7, wherein the image patch is an image patch in which a pixel size is smaller than 1200 dpi and which includes a plurality of isolated minute points.

9. The image forming apparatus according to claim 7, wherein the exposure parameter is an exposure resolution.

10. The image forming apparatus according to claim 9, wherein the picture quality maintaining control means changes the exposure resolution, set for the exposing means, by changing power of the light signal.

11. The image forming apparatus according to claim 9, wherein the picture quality maintaining control means changes the exposure resolution, set for the exposing means, by changing a pulse width used for the pulse width modulation.

12. The image forming apparatus according to claim 7, wherein the exposure parameter is an exposure pattern for forming the image of the minute point.

13. An image forming method of an image forming apparatus including a photoconductor, an exposure unit configured to expose the photoconductor by outputting a light signal subjected to a pulse width modulation, a developing unit configured to develop the photoconductor to form a developed image on the photoconductor, and a transfer unit configured to transfer the developed image onto a transfer-receiving member to form a transfer image, the image forming method comprising:

creating an image patch including a minute point;

detecting density information of a developed image of the image patch formed on the photoconductor or a transfer image of the image patch formed on the transfer-receiving member; and changing, in a case where the density information detected by the sensor unit is outside a range of a specified reference density, an exposure parameter for forming an image of the minute point so that the density information falls within the range of the specified reference density, wherein the exposure pattern is changed according to an increase of a usage time.

14. The image forming method according to claim 13, wherein the image patch is an image patch in which a pixel size is smaller than 1200 dpi and which includes a plurality of isolated minute points.

15. The image forming method according to claim 13, wherein the exposure parameter is an exposure resolution, and the exposure resolution, set for the exposure unit, is changed by changing power of the light signal.

16. The image forming method according to claim 13, wherein the exposure parameter is an exposure resolution, and the exposure resolution, set for the exposure unit, is changed by changing a pulse width used for the pulse width modulation.

17. The image forming method according to claim 13, wherein the exposure parameter is an exposure pattern for forming the image of the minute point.

* * * * *